US005472836A

United States Patent [19]

Haga

[11] Patent Number: 5,472,836

[45] Date of Patent: Dec. 5, 1995

[54] SILVER HALIDE PHOTOGRAPHIC EMULSION, SILVER HALIDE PHOTOGRAPHIC LIGHT-SENSITIVE MATERIAL AND PROCESSING METHOD FOR SILVER HALIDE PHOTOGRAPHIC LIGHT-SENSITIVE MATERIAL

[75] Inventor: Yoshihiro Haga, Tokyo, Japan

[73] Assignee: Konica Corporation, Japan

[21] Appl. No.: 212,492

[22] Filed: Mar. 11, 1994

[30] Foreign Application Priority Data

Mar. 15, 1993 [JP] Japan ..... 5-054003

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,806,461 | 2/1989 | Ikeda et al. | 430/567 |
| 4,977,074 | 12/1990 | Saitou et al. | 430/567 |
| 5,068,173 | 11/1991 | Takehara et al. | 430/567 |
| 5,266,450 | 11/1993 | Takehara | 430/567 |
| 5,275,930 | 1/1994 | Maskasky | 430/567 |
| 5,314,798 | 5/1994 | Brust et al. | 430/567 |

OTHER PUBLICATIONS

Patent Abstracts of Japan, vol. 17 No. 49 (P–1478) (5678) Jan. 26, 1993 JPA–4–263,246; Sep. 18, 1992.

*Primary Examiner*—Janet C. Baxter
*Attorney, Agent, or Firm*—Jordan B. Bierman; Bierman and Muserlian

[57] ABSTRACT

A silver halide photographic emulsion containing silver halide grains comprising {111} and {100} faces and having a silver iodide content of less than 2 mol %, wherein silver halide grains having 5 or more dislocations per grain account for not less than 50% of the total number of silver halide grains, the dislocations being located substantially on the {100} face.

4 Claims, No Drawings

SILVER HALIDE PHOTOGRAPHIC EMULSION, SILVER HALIDE PHOTOGRAPHIC LIGHT-SENSITIVE MATERIAL AND PROCESSING METHOD FOR SILVER HALIDE PHOTOGRAPHIC LIGHT-SENSITIVE MATERIAL

FIELD OF THE INVENTION

The present invention relates to a silver halide photographic emulsion, a silver halide photographic light-sensitive material incorporating said emulsion, and a method of processing a silver halide photographic light-sensitive material, more specifically a silver halide photographic light-sensitive material of excellent anti-pressure properties and improved developability.

BACKGROUND OF THE INVENTION

In recent years, there have been increasingly strict demands for silver halide photographic light-sensitive materials as to photographic performance stability, as well as high sensitivity and high image quality. For example, there is a need for improved resistance against pressure to which the silver halide photographic light-sensitive material being handled in picture taking, processing or other photographic operation, is exposed in various manners, whether accidentally or inevitably, from the viewpoint of photographic performance stabilization. Accordingly, various technical improvements have been proposed, mainly for silver halide photographic emulsions.

Meantime, quick processing at high temperatures has rapidly gained popularity for the processing of silver halide photographic light-sensitive materials; processing time has shortened in automatic processing of various silver halide photographic light-sensitive materials using automatic processing machines. For the purpose of rapid processing, it is necessary to offer sufficient sensitivity and gradation in short time.

Examples of traditional means of improving the anti-pressure properties of silver halide photographic light-sensitive materials include those described in U.S. Pat. No. 2,628,167 and Japanese Patent Publication Open to Public Inspection (hereinafter referred to as Japanese Patent O.P.I. Publication) Nos. 116025/1975 and 107129/1976, in which an iridium salt or thallium salt is added at the time of silver halide grain formation. However, these methods have a drawback of sensitivity reduction.

Also, Japanese Patent O.P.I. Publication Nos. 220238/1988 and 201649/1989 disclose improvements of the granularity, anti-pressure properties and exposure luminance dependence of silver halide photographic light-sensitive materials, while maintaining high sensitivity, by introducing dislocation to silver halide grains.

However, these prior art methods are subject to limitation as to the simultaneous improvement of anti-pressure properties and developability, so that they are unsatisfactory to meet the recent requirements of stable photographic performance and rapid processibility for current silver halide photographic light-sensitive materials. There is therefore a need for a further improved method.

SUMMARY OF THE INVENTION

The object of the present invention is to provide a silver halide photographic emulsion of excellent anti-pressure properties and improved developability without the above-described problems, a silver halide photographic light-sensitive material incorporating said emulsion, and a method of processing a silver halide photographic light-sensitive material.

The above object of the present invention is accomplished by the constituents described in the following (1) through (5).

(1) A silver halide photographic emulsion containing silver halide grains composed mainly of a {111} face and a {100} face and having an average silver iodide content of lower than 2 mol %, wherein silver halide grains having 5 or more dislocations per grain account for not less than 50% (by number) of the total number of silver halide grains and wherein the dislocations are located substantially on the {100} face.

(2) The silver halide photographic emulsion of term (1) above, wherein said silver halide grains have two mutually parallel twin planes.

(3) The silver halide photographic emulsion of term (1) above, wherein said silver halide grains are tabular silver halide grains each having two twin planes parallel to the principal plane face.

(4) A silver halide photographic light-sensitive material having at least one silver halide emulsion layer on the support, wherein at least one silver halide emulsion layer contains the silver halide photographic emulsion of any one of terms (1), (2) and (3) above.

(5) A method of processing a silver halide photographic light-sensitive material having at least one silver halide emulsion layer on the support, wherein at least one silver halide emulsion layer contains the silver halide photographic emulsion of any one of terms (1), (2) and (3) above, by photographic processes including a hardener-free processing bath for a total processing time of 15 seconds to 90 seconds.

DETAILED DESCRIPTION OF THE INVENTION

The present invention is hereinafter described in detail.

The silver halide incorporated in the silver halide photographic emulsion of the present invention may be any optionally chosen silver halide for ordinary silver halide emulsions, such as silver bromide, silver iodobromide, silver iodochloride, silver chlorobromide, silver chloroiodobromide or silver chloride, with preference given to silver bromide, silver iodobromide and silver chloroiodobromide.

The silver halide grains contained in the silver halide photographic emulsion of the present invention may be such grains that a latent image is formed mainly on the surface thereof, or such grains that a latent image is formed mainly inside of the grain.

The silver halide grains contained in the silver halide photographic emulsion of the present invention are composed mainly of a {111} face and a {100} face.

In the present invention, "being composed mainly of a {111} face and a {100} face" means that a {111} face and a {100} face are present on the silver halide grain surface, and the sum of the areal ratio of the {111} face to the total surface area of the silver halide grain and the areal ratio of the {100} face is not lower than 60%.

In the present invention, the areal ratio of the face is preferably 1 to 50%, more preferably 2 to 30%, as defined below.

[{100} face area]/[{100} face area+{111} face area]×100=areal ratio (%) of {100} face.

This areal ratio can be obtained by the method of T. Tani [J. Imaging Sci., 29, 165 (1985)], based on the difference in adsorption dependency between the {111} and {100} faces in the adsorption of sensitizing dyes.

The silver halide grains contained in the silver halide photographic emulsion of the present invention may have a regular crystalline form such as cubic, octahedral or tetradecahedral, or an irregular crystalline form such as spherical or tabular.

Grain roundness can be obtained by electron microscopic observation of the silver halide grain.

In the present invention, it is preferable that not less than 50%, more preferably not less than 60%, and most preferably not less than 70%, by total projection area of silver halide grains have a {100} face and a {100} face on the surface thereof.

In the present invention, it is also preferable that the silver halide grains have two mutually parallel twin planes; more preferably, they are tabular silver halide grains having two twin planes parallel to the principal plane face.

Twin planes can be observed using a transmission electron microscope. Specifically, a sample is prepared by coating a silver halide photographic emulsion so that the principal plane face of each tabular silver halide grain is oriented to be almost parallel to the support. The sample is cut using a diamond cutter to yield a thin section of about 0.1 μm thickness. The section is observed for twin planes using a transmission electron microscope.

In the present invention, a twin crystal means a silver halide crystal wherein one or more twin planes are present. The morphological classification of twin crystals is described in detail by Klein and Meuzer (Photographishe Korrespondenz, Vol. 99, p. 99; ibid., Vol. 100, p. 57).

When tabular silver halide grains are used in the present invention, the average value of their diameter to thickness ratio (also referred to as aspect ratio) is not less than 1.1, preferably less than 8.0, and more preferably less than 5.0. This average value is obtained by averaging the values of diameter to thickness ratio from all tabular grains.

The grain diameter of a silver halide grain is expressed by the circle-equivalent diameter of the projected area of the silver halide grain (diameter of a circle having the same projection area as that of the silver halide grain), preferably 0.1 to 5.0 μm, more preferably 0.2 to 4.0 μm, and still more preferably 0.3 to 3.0 μm.

The silver halide photographic emulsion relating to the present invention may be of any type, whether polydispersed (grain size distribution is broad) or monodispersed (grain size distribution is narrow), with preference given to a monodispersed emulsion. It may also be a mixture of two or more such emulsions.

Here, the average grain size d is defined as the grain size di which gives a maximum value for the product $ni \times di^3$, wherein di denotes the grain diameter and ni denotes the number of grains having a diameter of di, significant up to three digits, rounded off at the last digit.

Grain size can be obtained by measuring the diameter of the grain or the projected area of a circle on an electron micrograph taken at ×10000 to 70000 magnification; the number of subject grains should not be less than 1000 randomly.

A highly monodispersed emulsion preferred for the present invention has a distribution width of not more than 20%, more preferably not more than 15%, as defined as follows:

(Grain size standard deviation/average grain size)×100 =distribution width (%)

Here, average grain size and standard deviation are obtained from grain diameter di as defined above.

Average grain size=$\epsilon dini/\epsilon ni$

When silver iodobromide is used in the present invention, it is preferable that the silver iodide content be less than 2 mol % on average for all silver halide grains.

The silver halide grains contained in the silver halide photographic emulsion of the present invention may be core/shell grains, in which silver iodide is concentrated in the inner portion thereof.

A core/shell grain consists of a core and a shell which covers the core, the shell comprising one or more layers. It is preferable that the core and shell have different silver iodide contents, with greater preference given to the case where the core has the highest silver iodide content.

The silver iodide content of the above-described core is preferably not lower than 2.5 mol % and not higher than the solid solution limit, more preferably not lower than 5 mol % and not higher than the solid solution limit. The silver iodide content of the outermost shell, i.e., the shell forming the outermost layer, is preferably not more than 5 mol %, more preferably 0 to 2 mol %. The ratio of core is preferably 2 to 60%, more preferably 5 to 50% of the total grain volume.

Although the silver iodide distribution of the core is usually uniform, it may be irregular. For example, the silver iodide content may increase on the gradient from the center to the outer portion, or a maximum or minimum concentration may be present in an intermediate region.

The silver iodide distribution in the silver halide grains relating to the present invention can be known by various physical measuring methods, such as those based on low temperature luminescence measurement or X-ray diffraction, as described in the Proceedings of the 1981 Annual Meeting of the Society of Photographic Science and Technology of Japan.

X-ray diffraction measurements can be taken with reference to "*Kiso Bunseki Kagaku Koza*", 24, "X-ray Analysis", published by Kyoritsu Shuppan.

In the standard measuring method based on x-ray diffraction, the diffraction curve of the (420) plane of silver halide is drawn by the powder method at a tube voltage of 40 kV and a tube current of 100 mV, for example, with Cu as the target and a Cu Kα beam as the X-ray source. Usually, measuring instrument resolution can be increased by choosing an appropriate slit width and scanning recording speed and correcting the diffraction angle with a standard sample such as silicone loaded at a goniometer step angle of 0.02 degrees.

In the present invention, the silver iodide content of each silver halide grain and the average silver iodide content of all silver halide grains can be obtained using an electron probe microanalyzer (EPMA method). In this method, a sample is prepared by thoroughly dispersing emulsion grains not in mutual contact and subjected to elemental analysis of minute portions thereof by X-ray analysis following electron beam excitation.

This method makes it possible to determine the halogen composition of each grain by obtaining the characteristic X-ray intensities of silver and iodine from each grain. The average silver iodide content can be obtained by averaging the EPMA-determined silver iodide contents of at least 50 grains.

The silver halide grains of the present invention are characterized by the presence of substantial dislocation on the {100} face. The presence on the {100} face means that the number of dislocations on the {100} face is 2 times or more than the number of dislocations on the {111} face and other planes, preferably 3 times or more, and more preferably 5 times or more.

Dislocations in the silver halide grains relating to the present invention can be observed by direct methods using a transmission electron microscope at low temperature, such as those described by J. F. Hamilton [Phot. Sci. Eng., 11, 57 (1967)] and by T. Shiozawa [J. Soc. Phot. Sci. Japan, 35, 213 (1972)]. Specifically, silver halide grains are taken out from the emulsion while making sure not to exert any pressure that causes dislocation in the grains, and they are placed on a mesh for electron microscopy, and the sample is observed by the transmission method under cooling conditions to prevent its damage (e.g. printing out) by electron beams. Since electron beam penetration is hampered as the grain thickness increases, sharper observations are obtained when using an electron microscopy of the high voltage type (over 200 KV for 0.25 μm thick grains).

From the thus-obtained photomicrographs of the grains, the position and number of dislocation lines in each grain can be obtained.

With respect to the position of dislocation in the silver halide grains relating to the present invention, it is preferable that the dislocation lines be present in the region between 0.58 L and L outwardly from the center of each silver halide grain, more preferably between 0.80 L and 0.98 L. Although the dislocation lines are roughly in the outward direction from the center, they are often snaky.

In the present invention, when dislocation is in the direction from the center of the silver halide grain toward the {100} face, the dislocation is said to be present on the {100} face. The dislocation may be snaky, and may not always reach the {100} face of the silver halide grain.

In the present invention, the center of a silver halide grain is defined by the method described by Inoue et al. in their abstract given on pages 46–48 of the Proceedings of a meeting of the Society of Photographic Science and Technology of Japan as follows: A fine silver halide crystal is dispersed and solidified in methacrylic resin and prepared as ultrathin sections using a microtome. With respect to the sectional sample of the maximum cross sectional area and other sectional samples whose cross sectional area is not less than 90% of the maximum cross sectional area, the tangential circle having the least area relative to the cross sections is drawn. The center of the circle is defined as the center of the silver halide grain.

In the present invention, the distance between the center and outer surface of a silver halide grain, distance L, is defined as the distance between the intersection of a direct line drawn outwardly from the center of the above-described circle with the outer periphery of the grain and the center of the circle.

With respect to the number of dislocations in the silver halide grains relating to the present invention, it is preferable that grains having 5 or more dislocations account for not less than 50% (by number) of the total number of silver halide grains. More preferably, grains having 5 or more dislocations account for not less than 70% (by number) of the total number of silver halide grains, and still more preferably, grains having 10 or more dislocations account for not less than 50% (by number) of the total number of silver halide grains.

In controlling the ratio of {100} face in the silver halide photographic emulsion of the present invention, Japanese Patent O.P.I. Publication No. 298935/1990 can serve for reference. More specifically, it is preferable to control silver halide grain growing pAg, silver halide solvent concentration, silver halide grain growing pH and other factors.

Introduction of dislocation to the silver halide grains of the silver halide photographic emulsion of the present invention can be achieved by, for example, forming a high iodine phase in the silver halide grains. In this case, the high iodine phase is preferably silver iodide, silver iodobromide or silver chloroiodobromide, more preferably silver iodide or silver iodobromide, and still more preferably silver iodide.

In the present invention, the high iodine phase is preferably localized below the {100} face, and the high iodine phase may be selectively epitaxially coordinated at such a position.

For this purpose, conversion by, for example, the addition of an iodide salt alone or epitaxial connection as described in Japanese Patent O.P.I. Publication Nos. 108526/1983, 133540/1984 and 162540/1984 may be used.

Dislocation can be introduced selectively to the {100} face in a silver halide grain having both a {111} face and a {100} face by previously adsorbing an adsorbent selectively to the {111} face and then applying the above-mentioned conversion method or epitaxial connection method to the remaining {100} face. Alternatively, such dislocation can be introduced by previously preparing a silver halide grain having different halogen compositions on the {111} and {100} faces thereof, then adsorbing an adsorbent selectively to the {111} face on the basis of the difference in adsorptivity according to the base halogen composition, and applying the above-described conversion method or epitaxial connection method to the absorbent-free {100} face alone.

An isothermal adsorption curve can be used in choosing an absorbent which shows different adsorptivities depending on type of plane, whether {111} or {100}, and base halogen composition.

Concerning the relations of the adsorption characteristic of adsorbent and plane type or base halogen composition or emulsion atmospheric factors such as pH, pAg and adsorption promoter, information is available from the literature: T. Tani, Journal of Imaging Science, 29, 165 (1985); T. H. James, The Theory of the Photographic Process, Fourth edition, MacMillan, New York, 1977, Chapters 1, 9 and 13; A. Herz and J. Helling, J. Colloid Interface Sci., 22, 391 (1966); S. L. Scrutton, J. Phot. Sci., 22, 69 (1974); J. Nys, Dye Sensitization, Bressanone Symposium, Focal Press, London, 1970, pp. 26–43 and 57–65.

In addition to antifogging agents and stabilizers, sensitizing dyes and pendant dyes can be used as adsorbents. These adsorbents may be used singly or in combination or in mixture.

Although the amount of adsorbent added is not subject to limitation, it is preferably below the saturation adsorption amount. Examples of adsorbents which are likely to adsorb selectively to the {111} face, rather than the {100} face, are given below.

Compound 1:
3,3'-dimethyl-thiazolino-dicarbocyanine bromide

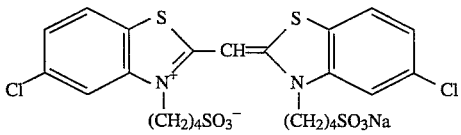

Compound 2

-continued

Compound 3

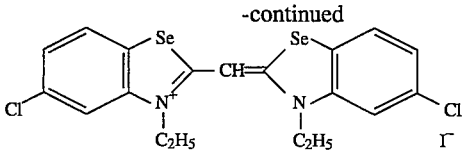

Compound 4

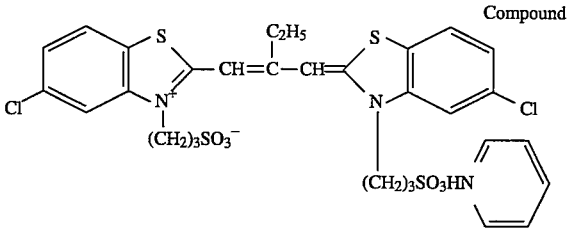

Compound 5

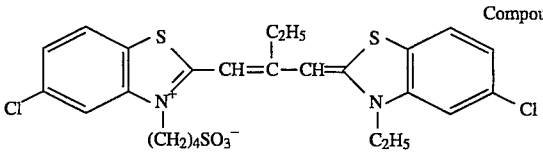

Compound 6

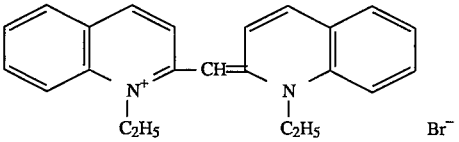

Compound 7

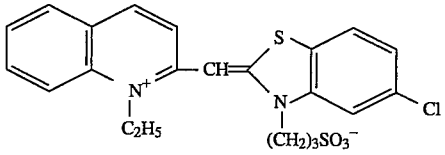

The silver halide grains contained in the silver halide photographic emulsion of the present invention are prepared by providing an aqueous solution containing a protective colloid and seed grains, and growing the seed grains while supplying silver ions, halogen ions or fine silver halide grains as necessary. The seed grains can be prepared by the single jet method, the controlled double jet method and other methods well known to those skilled in the art. The seed grains may have any halogen composition, whether silver bromide, silver iodide, silver chloride, silver iodobromide, silver chlorobromide, silver chloroiodide or silver chloroiodobromide, with preference given to silver bromide and silver iodobromide.

The seed grains used in the present invention may have a regular crystal form such as cubic, octahedral or tetradecahedral, or an irregular crystal form such as spherical or tabular. With respect to such grains, the ratio of {100} and {111} faces may be optionally chosen. The seed grains may have a complex crystalline form, and may be a mixture of grains of various crystalline forms.

The silver halide photographic emulsion relating to the present invention can be formed by various methods well known to those skilled in the art. In other words, the single jet method, the double jet method, the triple jet method and other methods can be optionally used in combination. The pAg and pH of the liquid phase in which silver halide is formed may be controlled to meet the silver halide growing speed.

The silver halide photographic emulsion of the present invention can be produced by any one of the acidic method, the neutral method and the ammoniacal method, In producing the silver halide photographic emulsion of the present invention, halide ions and silver ions may be added at the same time, or either may be added previously. Also, grains may be grown by sequentially or simultaneously adding halide ions and silver ions while controlling the pAg and pH in the mixing vessel in view of the critical growing speed of the silver halide crystal. The grain's silver halide composition may be changed by the conversion method at any stage of silver halide formation. Halide ions and silver ions, both in the form of fine silver halide grains, may be supplied to the mixing vessel. In determining the rate of ion addition, Japanese Patent O.P.I. Publication Nos. 48521/1979 and 49938/1983 serve for reference.

In producing the silver halide photographic emulsion of the present invention, known silver halide solvents such as ammonia, thioether and thiourea may be present.

The silver halide grains incorporated in the silver halide photographic emulsion of the present invention may be supplemented with metal ions, using at least one salt selected from the group consisting of cadmium salt, zinc salt, lead salt, thallium salt, iridium salt (including complex salt), rhodium salt (including complex salt) and iron salt (including complex salt), to contain such metal elements in and/or on the grains during formation and/or growth of the silver halide grains. Also, reduction sensitization specks can be provided in and/or on the grains by bringing the grains in an appropriate reducing atmosphere.

It is also preferable to deactivate the reducing agent, added at a given desired time during grain formation, to suppress or stop reduction, by adding an antioxidant such as hydrogen peroxide (water), an adduct thereof, a peroxo acid salt, ozone or $I_2$.

The antioxidant may be added at any time after silver halide grain formation and before gold sensitizer (chemical sensitizer when no gold sensitizers are used) addition for chemical sensitization.

In the present invention, it is preferable to use gelatin as a dispersant for the protective colloid for silver halide grains. Examples of gelatin for this purpose include alkali-treated gelatin, acid-treated gelatin, low molecular gelatin (molecular weight from 20000 to 100000) and modified gelatins such as phthalated gelatin. Non-gelatin hydrophilic colloids can also be used. Specifically, the hydrophilic colloids described in Term IX of Research Disclosure No. 17643 (December 1978) can be used.

The silver halide photographic emulsion of the present invention may, or may not, have unwanted soluble salts removed upon completion of silver halide grain growth. Such salts can be removed in accordance with the method described in Term II of Research Disclosure No. 17643.

In producing the silver halide photographic emulsion relating to the present invention, optimum conditions for items other than those described above can be chosen in accordance with known methods such as those described in Japanese Patent O.P.I. Publication Nos. 6643/1986, 14630/1986, 112142/1986, 157024/1987, 18556/1987, 92942/1988, 151618/1988, 163451/1988, 220238/1988 and 311244/1988.

In the present invention, the silver halide photographic emulsion may be chemically sensitized. Chemical ripening or chemical sensitization can be achieved under ordinary conditions used by those skilled in the art, without limitation on chemical ripening or chemical sensitization process conditions such as pH, pAg, temperature and duration. Chemical sensitization is achieved by sulfur sensitization, which uses a sulfur-containing compound or active gelatin capable of reacting with silver ions, selenium sensitization, which uses a selenium compound, tellurium sensitization, which uses a tellurium compound, reduction sensitization, which uses a reducing substance, noble metal sensitization, which uses gold or another noble metal. These sensitization methods may be used singly or in combination, with preference given to selenium sensitization, tellurium sensitization and reduction sensitization.

Examples of selenium sensitizers which can be used for the present invention include a wide range of selenium compounds such as those described in U.S. Pat. Nos. 1,574,944, 1,602,592 and 1,623,499 and Japanese Patent O.P.I. Publication Nos. 150046/1985, 25832/1992, 109240/1992 and 147250/1992. Useful selenium sensitizers include colloidal selenium metal, isoselenocyanates such as allyl isoselenocyanate, selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonylselenourea and N,N,N'-trimethyl-N'-4-nitrophenylcarbonylselenourea, selenoketones such as selenoacetone and selenoacetophenone, selenoamides such as selenoacetamide and N,N'-dimethylselenobenzamide, selenocarboxylic acids and selenoesters such as 2selenopropionic acid and methyl-3-selenobutyrate, selenophosphates such as tri-p-triselenophosphate, and selenides such as diethyl selenide and diethyl diselenide. The particularly preferable selenium sensitizers are selenoureas, selenoamides and selenoketones.

Specific examples of the use of these selenium sensitizers are given in U.S. Pat. Nos. 1,574,944, 1,602,592, 1,623,499, 3,297,446, 3,297,447, 3,320,069, 3,408,196, 3,408,197, 3,442,653, 3,420,670 and 3,591,385, French Patent Nos. 2,693,038 and 2,093,209, Japanese Patent Examined Publication Nos. 34491/1977, 34492/1987, 295/1978 and 22090/1982, Japanese Patent O.P.I. Publication Nos. 180536/1984, 185330/1984, 181337/1984, 187338/1984, 192241/1984, 150046/1985, 151637/1985, 246738/1986, 4221/1991, 24537/1991, 111838/1991, 116132/1991, 148648/1991, 237450/1991, 16838/1992, 25832/1992, 32831/1992, 96059/1992, 109240/1992, 140738/1992, 140739/1992, 147250/1992, 149437/1992, 184331/1992, 190225/1992, 191729/1992 and 195035/1992 and British Patent Nos. 255,846 and 861,984. Some examples are also given in scientific references such as H. E. Spencer et al., Journal of Photographic Science, Vol. 31, pp. 158–169 (1983).

Although the amount of selenium sensitizer used varies depending on type of selenium compound, silver halide grains, chemical ripening conditions and other factors, it is common practice to add the selenium sensitizer at about $10^{-8}$ to $10^{-4}$ mol per mol of silver halide. The selenium compound may be added in solution in an organic solvent such as water, methanol or ethanol or a mixture thereof, depending on the nature thereof, or in a mixture with a gelatin solution, or by the method disclosed in Japanese Patent O.P.I. Publication No. 140739/1992, in which the selenium compound is added in the form of an emulsion dispersion mixture with a polymer which is soluble in organic solvents.

Chemical ripening using a selenium sensitizer is preferably carried out at temperatures between 40° C. and 90° C., more preferably between 45° C. and 80° C., the preferable pH range being from 4 to 9 and the preferable pAg range being from 6 to 9.5.

Tellurium sensitization and tellurium sensitizers are disclosed in U.S. Pat. Nos. 1,623,499, 3,320,069, 3,772,031, 3,531,289 and 3,655,394, British Patent Nos. 235,211, 1,121,496, 1,295,462 and 1,396,696, Canadian Patent No. 800,958 and Japanese Patent O.P.I. Publication No. 204640/1992. Useful tellurium sensitizers include telluroureas and telluroamides.

Tellurium sensitizers are used in the same manner as for selenium sensitizers.

It is also preferable to perform reduction sensitization by exposing the emulsion to an appropriate reducing atmosphere to provide reduction sensitization specks for the inside and/or surface of grains thereof.

Examples of preferable reducing agents include thiourea dioxide, ascorbic acid and derivatives thereof. Other preferable reducing agents include polyamines such as hydrazine and diethylenetriamine, dimethylaminoboranes and sulfites.

The amount of reducing agent added is preferably varied according to type of reduction sensitizer, grain size, composition and crystal habit of silver halide grains, temperature, pH, pAg and other environmental factors of reaction system, For example, in the case of thiourea dioxide, favorable results are obtained when it is used at about 0.01 to 2 mg per mol of silver halide. In the case of ascorbic acid, the preferable range is from about 50 mg to 2 g per mol of silver halide.

Preferable conditions of reduction sensitization are about 40° to 70° C. temperature, about 10 to 200 minutes duration, about 5 to 11 pH and about 1 to 10 pAg, pAg being the reciprocal of the $Ag^+$ ion concentration.

The water-soluble silver salt is preferably silver nitrate. By the addition of a water-soluble silver salt, so-called silver ripening, a kind of reduction sensitization technology, is performed. The appropriate pAg range for silver ripening is from 1 to 6, preferably from 2 to 4. Temperature, pH, duration and other factors are preferably set within the above-described conditions of reduction sensitization.

Although common stabilizers as described below can be used to stabilize a silver halide photographic emulsion containing silver halide grains subjected to reduction sensitization, good results are often obtained when they are used in combination with the antioxidant disclosed in Japanese Patent O.P.I. Publication No. 82831/1982 and/or the thiosulfonic acid described in a paper by V. S. Gahler [Zeitshrift fur Wissenschaftliche Photographie Bd. 63, 133 (1969)] or Japanese Patent O.P.I. Publication No. 1019/1979. These compounds may be added at any time in the emulsion production process from crystal growth to emulsion preparation just before coating.

In the present invention, selenium sensitization, tellurium sensitization and reduction sensitization may be used in combination. It is preferable to use these sensitization methods in combination with other sensitization methods such as noble metal sensitization.

In the method of the present invention for processing a silver halide photographic light-sensitive material, a silver halide photographic light-sensitive material containing the silver halide photographic emulsion of the present invention is processed by photographic processes including a hardener-free processing bath for a total processing time of 15 seconds to 90 seconds.

The photographic emulsion relating to the present invention can incorporate various photographic additives added before or after physical or chemical ripening. Examples of known photographic additives include the compounds described in Research Disclosure (hereinafter referred to as RD) Nos. 17643 (December 1978), 18716 (November 1979) and 308119 (December 1989). The compounds and portions where they are described are given below.

| Additive | RD-17643 Page | RD-17643 Category | RD-18716 Page | RD-18716 Category | RD-308119 Page | RD-308119 Category |
|---|---|---|---|---|---|---|
| Chemical sensitizer | 23 | III | 648 upper right | | 996 | III |
| Sensitizing dye | 23 | IV | 648–649 | | 996–998 | IV |
| Desensitizing dye | 23 | IV | | | 998 | IV |
| Dye | 25–26 | VIII | 649–650 | | 1003 | VIII |
| Developing accelerator | 29 | XXI | 648 upper right | | | |
| Antifogging agent and stabilizer | 24 | IV | 649 upper right | | 1006–1007 | VI |
| Brightening agent | 24 | V | | | 998 | V |
| Hardener | 26 | X | 651 left | | 1004–1005 | X |
| Surfactant | 26–27 | XI | 650 right | | 1005–1006 | XI |
| Antistatic agent | 27 | XII | 650 right | | 1006–1007 | XIII |
| Plasticizer | 27 | XII | 650 right | | 1006 | XII |
| Lubricant | 27 | XII | | | | |
| Matting agent | 28 | XVI | 650 right | | 1008–1009 | XVI |
| Binder | 26 | XXII | | | 1003–1004 | IX |
| Support | 28 | XVII | | | 1009 | XVII |

Examples of supports which can be used in the light-sensitive material relating to the present invention include those specified on page 28 of RD-17643 and page 1009 of RD-308119.

Appropriate supports are plastic films etc., whose surface may be subbed or treated by corona discharge or ultraviolet irradiation to enhance coating layer adhesion.

EXAMPLES

The present invention is explained by the following examples but is not limited by these.

Example 1

Preparation of Seed Emulsion

Monodispersed spherical seed emulsion was prepared in accordance with the method disclosed in Japanese patent O.P.I. Publication 61-6643/1986. Thus, using the following four kinds of solutions, Seed Emulsion-1 was prepared.

| | |
|---|---|
| ASolution A1 | |
| Ossein gelatin | 150 g |
| Potassium bromide | 53.1 g |

-continued

| | |
|---|---|
| Potassium iodide | 14.6 g |
| Water to make | 7.2 l |
| Solution B1 | |
| Silver nitrate | 1500 g |
| Water to make | 6 l |
| Solution C1 | |
| Potassium bromide | 1327 g |
| 1-Phenyl-5-mercaptotetrazol (dissolved in methanol) | 0.8 g |
| Water to make | 3 l |
| Solution D1 | |
| Aqueous ammonia solution | 705 ml |

Solutions B1 and C1 were added into Solution A1 by double jet method over period of 30 sec., while stirring vigorously at 40 ° C., to form nuclei. pBr was within 1.09 to 1.15 during the time of addition thereof. After 1 min. 30 sec., solution D1 was added for 20 sec. and ripening was further carried out over period of 5 min. During ripening, concentrations of KBr and ammonia were 0.071 and 0.63 mol/l, respectively.

Then, after pH was adjusted to 6.0, desalination washing was carried out. Observation with an electron microscope revealed that a resulting seed emulsion comprised monodispersed spherical grains having an average size of 0.26 μm and a distribution width of 18%.

Preparation of Emulsion Em-1

| | |
|---|---|
| Solution A2 | |
| Ossein gelatin | 6 g |
| Sodium polypropyleneoxy-polyethyleneoxy-disuccinate (10% methanol solution) | 1.4 ml |
| Seed emulsion-1 | 0.1 mol eq. |
| Water to make | 570 ml |
| solution B2 | |
| Ossein gelatin | 9.4 g |
| Potassium bromide | 69 g |
| Potassium iodide | 5.4 g |
| Water to make | 396 ml |
| Solution C2 | |
| Ossein gelatin | 6.2 g |
| Potassium bromide | 46 g |
| Water to make | 264 ml |
| Solution D2 | |
| Silver nitrate | 167 g |
| Water to make | 890 ml |

Solutions B2 and D2 were added into solution A2 according to double jet method, while stirring vigorously at 65 ° C. At the time when an addition of solution B2 was completed, i.e. 60% of the total amount of silver nitrate was added, an addition of solution D2 was intermittently stopped and solution T as below was added at a constant rate over a period of one min. After ripening was carried out over a five min.period, solutions C2 and D2 were added according to doublr jet method over a 112 min. period. During the addition, pH and pAg were maintained at 5.8 and 8.8, respectively. Addition rates of solutions B2 and D2 were each linearly increased in such a way that the rate at the end was 6.4 time that of the start.

Solution T: 15 ml of a solution containing potassium iodide of 0.005 mol per mol of emulsion Em-1

After completing the addition, the resulting emulsion was desalted using aqueous solutions of Demol (product of Kao Atlas) and magnesium sulfate. Thereafter, pAg and pH of the resulting emulsion were adjusted to 8.5 and 5.85 at 40 ° C.

Electron microscopic observation of the resulting emulsion revealed that the emulsion had an average size of 0.98 μm and a size distribution width of 18%; 82% of the projection area of the total grains was accounted for by tabular silver halide grains comprising {111} and {100} faces, having an average aspect ration of 4.0.

Preparation of Emulsion Em-2

Comparative emulsion Em-2 containing tabular grains was prepared in the same manner as in emulsion Em-1 except that an amount of potassium iodide in solution B2 was change to 1.8 g. Electron microscopic observation of the resulting emulsion revealed that the emulsion had average size of 0.98 μm and size distribution width of 14%; 83% of the projection area of the total grains was accounted for by silver halide tabular grains comprising {111} and {100} faces, having an average aspect ratio of 4.0.

Preparation of Emulsion Em-3

Comparative tabular grain emulsion Em-3 was prepared in the same manner as in comparative emulsion Em-1 except that at the time when an addition of solution B2 (60% of the total amount of silver nitrate was added), an addition of solution D2 was intermittently stopped, solution U as described below was added over a 30 sec. period and after 10 min. of ripening, solution T was added.

Solution U: A solution containing $1\times10^{-4}$ mol of compound 6 per mol of emulsion Em-3 (25 ml)

Electron microscopic observation of the resulting emulsion revealed that the emulsion had an average grain size of 0.98 μm and a size distribution width of 19% and 82% of the projection area of the total grains was accounted for by silver halide tabular grains comprising {111} and {100} faces, having an average aspect ratio of 4.0.

Preparation of Emulsion Em-4

Tabular grain emulsion Em-4 of the invention was prepared in the same manner as in comparative emulsion EM-2 except that at the time when an addition of solution B2 (thus, 60% of the total amount of silver nitrate was added), an addition of solution D2 was intermittently stopped, solution U was added, over a 30 sec. period, in the same amount as in Em-3 and after ripening for 10 min., solution T was added. Electron microscopic observation of the resulting emulsion revealed that the emulsion had an average grain size of 0.98 μm and a size distribution width of 15% and 83% of the projection area of the total grains was accounted for by silver halide tabular grains comprising {111} and {100} faces, having an average aspect ratio of 4.0.

Preparation of Emulsion Em-5

Tabular grain emulsion Em-5 of the invention was prepared in the same manner as in emulsion Em-4 except that pAg during mixing was changed to 8.6.

Electron microscopic observation of the resulting emulsion revealed that the emulsion had an average grain size of 0.98 μm and a size distribution width of 14%, 82% of the projection area of the total grains was accounted for by silver halide tabular grains comprising {111} and {100} faces, having an average aspect ratio of 3.7.

Preparation of Emulsion Em-6

An inventive tabular grain emulsion comprising a core containing a high iodide was prepared using Seed emulsion-1 and the following four kinds of solutions.

| | |
|---|---|
| solution A3 | |
| Ossein gelatin | 11.7 g |
| Sodium polypropyleneoxy-polyethylene-disuccinate (10% methanol solution) | 1.4 ml |
| Seed emulsion-1 | 0.1 mol eq. |
| Water to make | 550 ml |
| Solution B3 | |
| Ossein gelatin | 5.9 g |
| Potassium bromide | 5.0 g |
| Potassium iodide | 1.6 g |
| Water to make | 145 ml |
| Solution C3 | |
| Silver nitrate | 10.1 g |
| Water to make | 145 ml |
| Solution D3 | |
| Ossein gelatin | 6.1 g |
| Potassium bromide | 94 g |
| Water to make | 304 ml |
| Solution E3 | |
| Silver nitrate | 137 g |
| Water to make | 304 ml |

Solutions B3 and C3 were added into solution A3 over a 58 min. period by double jet method, while stirring vigorously at 70 ° C. Subsequently, solutions D3 and E3 were added therein by the double jet method, provided that at the time when 60% Of the total amount of silver nitrate was added, the addition of solutions D3 and E3 was intermittently stopped and solution U as described above was added over a 30 sec. period and after 5 min.ripening, solutions D3 and E3 were further added therein over a period of 48 min. by double jet method. During the addition, pH and pAg were maintained at 5.8 and 8.5, respectively. After completing the addition, the emulsion was desalted and adjusted to pH of 5.85 and pAg of 8.5 at at 40 ° C. in the same manner as in emulsion Em-1.

Electron microscopic observation of the resulting emulsion revealed that the emulsion had an average grain size of 0.98 μm and a size distribution width of 15%, 81% of the projection area of the total grains was accounted for by silver halide tabular grains comprising {111} and {100} faces and having an average aspect ratio of 3.7.

Preparation of Seed Emulsion-2

Seed emulsion-2 was prepared in a manner as follows.

| | |
|---|---|
| Solution A4 | |
| Ossein gelatin | 24.2 g |
| Water to make | 9657 ml |
| Sodium polypropyleneoxypolyethyleneoxy-disuccinate (19% methanol solution) | 6.78 ml |
| Potassium bromide | 10.8 g |
| 10% Nitric acid | 114 ml |

-continued

| | |
|---|---|
| Solution B4 | |
| 2.5 N silver nitrate solution | 2825 ml |
| Solution C4 | |
| Potassium bromide | 824 g |
| Potassium iodide | 18.8 g |
| Water to make | 2825 ml |
| Solution D4 | |
| 1.75 N potassium bromide solution used for adjusting Ag-electrode potential | |

By means of a stirring mixer disclosed in Japanese Examined Patent 58-58288/1983 and 58-58289/1983, 464.3 ml of solutions B4 and C4, respectively, were added in solution A4 over a 2 min. period to form nucleus grains. The addition of solutions B4 and C4 was intermittently stopped and a temperature of the mixture solution was increased to 60 ° C. over a period of 60 min. After pH was adjusted to 5.0 with the use of 3% KOH solution, solutions B4 and C4 were further added at a rate of 55.4 ml/min. over a period of 42 min. by double jet method. During a period of increasing temperature of 35 to 60 ° C. and subsequent addition of solutions B4 and C4, silver electrode potential of the mixture solution was controlled within a range of +8 to +16 mV. The silver electrode potential was measured with a silver ion-selective electrode using a saturated Ag/AgCl electrode as a reference electrode.

After completing the addition, the emulsion was adjusted to pH of 6 and subjected to desalination washing. Electron microscopic observation of the resulting emulsion revealed that 90% or more of the projection area of the total grains of the seed emulsion comprised hexagonal tabular grains having an adjacent edge ratio of 1.0 to 2.0, an average thickness of 0.06 μm and an average diameter (circule-equivalent diameter) of 0.59 μm.

Preparation of Emulsion Em-7

A tabular grain emulsion Em-7 of the invention was prepared in the same manner as in emulsion Em-5 except that Seed emulsion-1 was replaced by Seed emulsion-2.

Electron microscopic observation of the resulting emulsion revealed that the emulsion had an average grain size of 0.98 μm and a size distribution of 14%, and 88% of the projection area of the total grains was accounted for by silver halide tabular grains comprising {111} and {100} faces, having an average aspect ratio of 4.2.

Preparation of Emulsion Em-8

A tabular grain emulsion of the invention was prepared in the same manner as in emulsion Em-6 except that Seed emulsion-1 was replaced by Seed emulsion-2.

Electron microscopic observation of the resulting emulsion revealed that the emulsion had an average grain size of 0.98 μm and a size distribution of 15%, and 88% of the projection area of the total grains was accounted for by silver halide tabular grains comprising {111} and {100} faces, having an average aspect ratio of 4.2.

Dislocations in the silver halide grains contained in each of above emulsions were observed with a transmission electron microscope. As a result, silver halide grain having 10 or more of dislocation lines per grain accounted for not less than 50% by number of total grains contained in each of emulsions Em-1 through Em-8. In emulsions Em-1 and Em-2, dislocations were randomly located on both {111} and {100} faces. In emulsions Em-3 through Em-8, on the other hand, the dislocations were located substantially on {100} face. In addition, the dislocations were located in a range of 0.86 L to 0.98 L.

Observation of the twin plane revealed that the proportion by number of grains having two or more twin planes parallel to the principal plane accounted for 60% in emulsions Em-1 to Em-6 and 82% in emulsions Em-7 and Em-8. Characteristics of emulsions Em-1 to Em-8 are shown in Table 1.

TABLE 1

| Emulsion | Average iodide content | Proportion of {100} face by area (%) | Dislocation |
|---|---|---|---|
| Em-1 (Comp.) | 3.5 | 11 | Randomly located on {111} and {100} faces |
| Em-2 (Comp.) | 1.5 | 12 | Randomly located on {111} and {100} faces |
| Em-3 (Comp.) | 3.5 | 11 | Substantially located on {100} face |
| Em-4 (Inv.) | 1.5 | 12 | Substantially located on {100} face |
| Em-5 (Inv.) | 1.5 | 18 | Substantially located on {100} face |
| Em-6 (Inv.) | 1.5 | 20 | Substantially located on {100} face |
| Em-7 (Inv.) | 1.5 | 10 | Substantially located on {100} face |
| Em-8 (Inv.) | 1.5 | 10 | Substantially located on {100} face |

Example 2

A mixture of sensitizing dyes (A) and (B) in a weight ratio of 100:1 was added, in an amount of 600 mg/mol AgX, into each of emulsions Em-1 to Em-8 prepared in Example 1. After 10 min.,chemical ripening was optimally carried out-by adding optimum amounts of chloroauric acid, sodium thiosulfate and ammonium thiocyanate. After completing the ripening, 4-hydroxy-6-methyl-1,3,3a,7-tetrazaindene was added therein in an amount of $3\times10^{-2}$ mol per mol of silver halide so as to stabilize the emulsion.

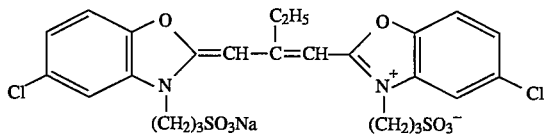

Spectral sensitizing dye A

-continued

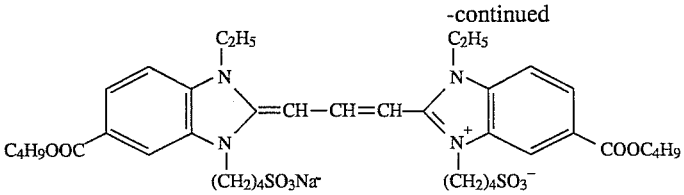

Spectral sensitizing dye B

The following additives were added into each of emulsions chemically-sensitized to prepare an coating solution of silver halide emulsion. The additives are as follows and an addition amount is moles per mol of silver halide.

| | |
|---|---|
| 1,1-Dimethylol-1-brom-1-nitromethane | 70 mg |
| t-Butyl-catechol | 400 mg |
| Polyvinylpyrrolidone (M.W. 10,000) | 1.0 g |
| Stylenr-malleic acid copolymer | 2.5 g |
| Nitrophenyl-triphenylphosphonium chloride | 50 mg |
| 2-anilino-4,6-dimercaptotriazine | 40 mg |
| Ammonium 1,3-dihydroxybezene-4-sulfonate | 2 g |
| $C_4H_9OCH_2CH(OH)CH_2(CH_2COOH)_2$ | 1 g |
| 1-Phenyl-5-mercaptotetrazole | 15 mg |
| 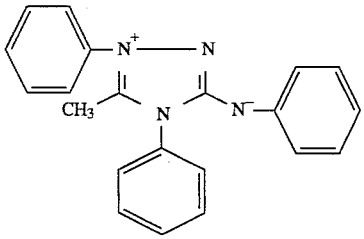 | 150 mg |
| 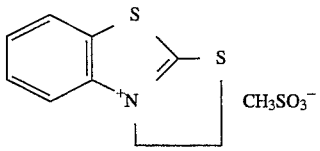 | 70 mg |

Additives for protective layer solution are as follows and an addition amount thereof is an amount per 11 of coating solution.

| | |
|---|---|
| Lime-treated inert gelatin | 68 g |
| Acid treated gelatin | 2 g |
| Sodium i-amyl-n-decylsulfosuccinate | 1 g |
| Polymethylmeteacrylate (area mean diameter: 3.5 μm, matting agent) | 1.1 g |
| Silicon dioxide (area mean diameter: 1.2 μm matting agent) | 0.5 g |
| $(CH_2{=}CHSO_2CH_2)_2O$ | 500 mg |
| $C_4F_9SO_3K$ | 2 mg |
| $C_{12}H_{25}CONH(CH_2CH_2O)_5H$ | 2.0 mg |
| 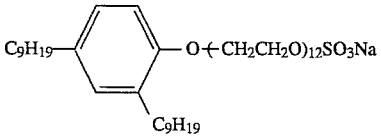 | 1.0 g |
| 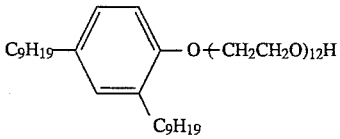 | 0.4 g |

-continued

| | |
|---|---|
| 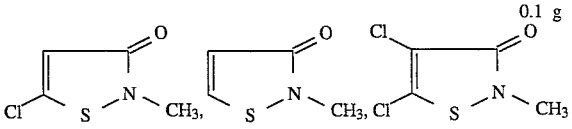 | 0.1 g |

(50:46:4)

Resulting emulsion coating solution and protective layer coating solution were coated simultaneously and double-sidedly on a subbed polyethyleneterephthalate film base having a thickness of 175 μm and tinted with blue at a speed of 80 m/min.using two slide hopper type coaters so as to give a silver weight of 1.9 g/m$^2$ and a gelatin coating weight of 2.0 g/m$^2$ for emulsion and 1.0 g/m$^2$ for protective layer, and samples 1 to 8 were prepared.

Each sample was held between two intensifying screens (K-250) and then irradiated, through an aluminum wedge, in 0.05 second with X-rays at a tube voltage of 80 kvp and a tube current of 100 mA, followed by developing for 8, 15 or 25 sec. with the following developer, fixing washing and drying in a roller transport type automatic processor. In the case when developed for 15 sec., processing time was 45 sec. in terms of dry to dry. (Developing: 35 ° C., Fixing: 33° C., Washing: 20° C., and Drying: 50° C.).

Compositions of a developer and a fixer used in the present invention are as follows.

| | |
|---|---|
| Developer | |
| Part-A (to be made up to 12 liters) | |
| Potassium hydroxide | 450 g |
| Potassium sulfite (50% solution) | 2280 g |
| Diethylenetetraminepentaacetic acid | 120 g |
| Sodium hydrogencarbonate | 132 g |
| 5-Methylbenzotriazole | 1.2 g |
| 1-phenyl-5-mercaptotetrazole | 0.2 g |
| Hydroquinone | 340 g |
| Water to make | 5000 ml |
| Part-B (to be made up to 12 liters) | |
| Glacial acetic acid | 170 g |
| Triethylene glycol | 185 g |
| 1-Phenyl-3-pyrazolidone | 22 g |
| 5-Nitroindazole | 0.4 g |
| Starter | |
| Glacial acetic acid | 120 g |
| Potassium bromide | 225 g |
| Water to make | 1.0 l |
| Fixer | |
| Part-A (to be made uo to 18 liters) | |
| Ammonium thiosulfate (70/vol %) | 6000 g |
| Sodium sulfite | 110 g |
| Sodium acetate trihydrate | 450 g |

-continued

| | |
|---|---|
| Sodium citrate | 50 g |
| Gluconic acid | 70 g |
| 1-(N,N-dimethylamino)-ethyl-5-mercaptoterazole | 18 g |
| Part-B | |
| Aluminium sulfate | 800 g |

Developer part-A and part-B were simultaneously added to about five liters of water, water was added thereto wit stirring to make up 12 liters, and the pH was adjusted to 10.40 with glacial acetic acid. A developer replenisher was thus obtained.

To 1 liter of developer replenisher was added the above starter in an amount of 20 ml/l. The pH was then adjusted to 10.26 to obtain a solution ready for use. To prepare a fixer, fixer part-A and part-B were added simultaneously to about 5 liters of water, and water was added thereto with stirring to make up 18 liters, followed by pH adjustment to 4.4 with sulfur in acid and sodium hydroxide. Obtained was a fixing replenisher ready for use.

Thus processed samples were evaluated with respect to sensitivity and gradient (gradation). The sensitivity was given by a reciprocal of the exposure necessary to obtain a density of fog+1.0 and expressed in a value relative to the sensitivity of the sample developed for 25 sec. which was set to 100. Gradation was expressed in term of a slope of line connecting points corresponding to densities of fog+0.25 and fog+2.0.

Evaluation was also made with respect to pressure mark (roller mark) due to a roller of automatic processor when an unexposed sample was processed with opposed roller type autoprocessor over a period of 45 sec. in dry to dry, the occurrence of roller marks was visually judged and the assessment thereof was classified into the following five class. Results thereof were shown in Table 2.

5; No roller mark occurred.

4: Marks slightly occurred.

3: Marks occurred in some degree. (within practical use allowable)

2: Many marks occurred (outside of practical use)

1: Remarkably many marks occurred.

TABLE 2

| Sample No. | Emulsion | Development kinetic characteristic: Sensitivity 8" | 15" | 25" | Gradient 9" | 15" | 25" | Pressure characteristics (Roller marks) |
|---|---|---|---|---|---|---|---|---|
| 1 | Em-1 | 68 | 88 | 100 | 2.00 | 2.40 | 2.60 | 2 |

TABLE 2-continued

| Sample No. | Emulsion | Development kinetic characteristic: Sensitivity 8" | 15" | 25" | Gradient 9" | 15" | 25" | Pressure characteristics (Roller marks) |
|---|---|---|---|---|---|---|---|---|
| (Comp.) 2 | Em-2 | 85 | 100 | 100 | 2.40 | 2.70 | 2.85 | 1 |
| (Comp.) 3 | Em-3 | 70 | 90 | 100 | 2.05 | 2.45 | 2.65 | 2 |
| (Comp.) 4 (Inv.) | Em-4 | 93 | 100 | 100 | 2.77 | 2.85 | 2.85 | 4 |
| 5 (Inv.) | Em-5 | 95 | 100 | 100 | 2.79 | 2.85 | 2.85 | 4 |
| 6 (Inv.) | Em-6 | 100 | 100 | 100 | 2.80 | 2.85 | 2.85 | 5 |
| 7 (Inv.) | Em-7 | 93 | 100 | 100 | 2.76 | 2.83 | 2.83 | 4 |
| 8 (Inv.) | Em-8 | 100 | 100 | 100 | 2.78 | 2.84 | 2.84 | 5 |

As can be seen from the table, inventive samples are superior in pressure resistance; sufficient sensitivity and gradation can be obtained even when processed over a short time period and improved developability was achieved, as compared to comparative samples.

What is claimed is:

1. A silver halide photographic emulsion comprising silver iodobromide tabular grains each having two twin planes parallel to a principal plane face of the grain, said tabular grains comprising a {111} face and a {100} face and having a silver iodide content of less than 2 mol %, at least 50 % of said tabular grains having 5 or more dislocations per grain, said dislocations being located substantially on the {100} face.

2. The silver halide emulsion of claim 1 wherein said silver iodobromide tabular grains have an average aspect ratio of grain diameter to grain thickness of 1.1 to less than 8.0.

3. The silver halide emulsion of claim 1 wherein said silver iodobromide tabular grains each have a core/shell structure comprising a core having an iodide content of 2.5 mol % to a solid solution limit, and a shell comprising one or more layers.

4. A silver halide photographic light-sensitive material comprising a support having thereon a silver halide emulsion layer, wherein said silver halide emulsion layer comprises silver iodobromide tabular grains each having two twin planes parallel to a principal plane face of the grain, said tabular grains comprising a {111} face and a {100} face, and a silver iodide content of less than 2 mol %, at least 50 % of a total number of said tabular silver halide grains having 5 or more dislocations per grain, said dislocations being located substantially on the {100} face.

* * * * *